US007992993B2

(12) United States Patent
Hiroki et al.

(10) Patent No.: US 7,992,993 B2
(45) Date of Patent: Aug. 9, 2011

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 600 days.

(21) Appl. No.: 11/619,726

(22) Filed: Jan. 4, 2007

(65) Prior Publication Data

US 2008/0165241 A1 Jul. 10, 2008

(51) Int. Cl.
*B41J 2/01* (2006.01)
*B41J 3/407* (2006.01)

(52) U.S. Cl. ..... 347/106; 347/101; 347/104; 347/105

(58) Field of Classification Search ..... 347/101, 347/104, 105, 106
See application file for complete search history.

(56) References Cited

U.S. PATENT DOCUMENTS 5,623,329 A * 4/1997 Yamauchi et al. ..... 399/314
2003/0063936 A1* 4/2003 Sasaki et al. ..... 399/401
2005/0194730 A1* 9/2005 Nishida et al. ..... 271/10.01
2008/0165215 A1 7/2008 Hiroki et al.
2008/0165218 A1 7/2008 Hiroki et al.
2008/0165220 A1 7/2008 Hiroki et al.
2008/0165231 A1 7/2008 Hiroki et al.
2008/0165236 A1 7/2008 Hiroki et al.
2008/0165238 A1 7/2008 Hiroki et al.
2008/0165239 A1 7/2008 Hiroki et al.
2008/0165240 A1 7/2008 Hiroki et al.
2008/0165242 A1* 7/2008 Hiroki et al. ..... 347/104

FOREIGN PATENT DOCUMENTS

JP 2006-193317 7/2006

* cited by examiner

*Primary Examiner* — Matthew Luu
*Assistant Examiner* — Kendrick X Liu
(74) *Attorney, Agent, or Firm* — Turocy & Watson, LLP

(57) ABSTRACT

An image forming apparatus for printing on a sheet by a recording head, includes a sheet transport mechanism to transport the sheet in a specified direction; a paper loading unit to contain the stacked sheet before printing; a second transport mechanism to transport the sheet through a second transport path from the paper loading unit to a temporal containing unit a state where a front-back direction of the sheet is kept; and a third transport mechanism to transport the sheet through a third transport path from the temporal containing unit between the recording head and the sheet guide member in a state where the front-back direction of the sheet is kept.

10 Claims, 4 Drawing Sheets

METHOD AND APPARATUS FOR FORMING IMAGE

BACKGROUND OF THE INVENTION

1. Field of the Invention

The present invention relates to an image forming apparatus for printing an image on a sheet such as, for example, a printing paper, and particularly to an image forming apparatus in which paper capacity is increased and which includes a transport path suitable for a thick sheet.

2. Description of the Related Art

In image forming apparatuses including a recording head of an ink-jet system, there is known an image forming apparatus in which a head recording unit is moved vertically to a paper transport direction and image formation is performed. In the image forming apparatus as stated above, in order to increase the paper capacity, a paper cassette is arranged below the head recording unit, and paper feed is performed from this paper cassette. At this time, because of the securing of printing speed and the like, it is necessary to shorten the length of a transport path. Thus, a paper fed from the paper cassette passes through the transport path having a small radius of curvature. JP-A-2006-193317 discloses a U-turn transport apparatus for inverting a paper.

On the other hand, there is also known an image forming apparatus including paper feed means from the back in order to increase a radius of curvature.

However, in the case where the paper cassette is arranged below the head recording unit, since the radius of curvature of the transport path becomes small, there has been a problem that when a sheet having toughness of a certain degree or more, such as a thick sheet, is made to pass, the sheet is curled, or a paper jam occurs. On the other hand, in the case where the paper feed means from the back is used, there has been a problem that the capacity is not increased very much, and when the paper is left as it is, dust is accumulated.

It is an object of the invention to provide an image forming apparatus and an image forming method in which in a case where a paper cassette is arranged below a head recording unit in order to increase paper capacity, even in a case where a thick sheet is used, it is possible to prevent a curl or a paper jam from occurring.

BRIEF SUMMARY OF THE INVENTION

According an aspect of the invention, an image forming apparatus for printing on a sheet by a recording head of an ink-jet system includes a carriage on which the recording head is mounted, a carriage drive mechanism including a motor to reciprocate the carriage, a sheet transport mechanism to transport the sheet in a direction orthogonal to a movement direction of the carriage, a sheet guide member arranged below the recording head and having a guide unit which is opposite to the recording head and on which the sheet passes, a paper loading unit arranged below the recording head and containing the stacked sheet before printing, a first transport path to transport the sheet from the paper loading unit to between the recording head and the sheet guide member while inverting the sheet, a second transport path to transport the sheet from the paper loading unit to a temporal containing unit in a state where a front-back direction of the sheet is kept, and a third transport path to transport the sheet from the temporal containing unit to between the recording head and the sheet guide member in a state where the front-back direction of the sheet is kept.

Objects and advantages of the invention will become apparent from the description, which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
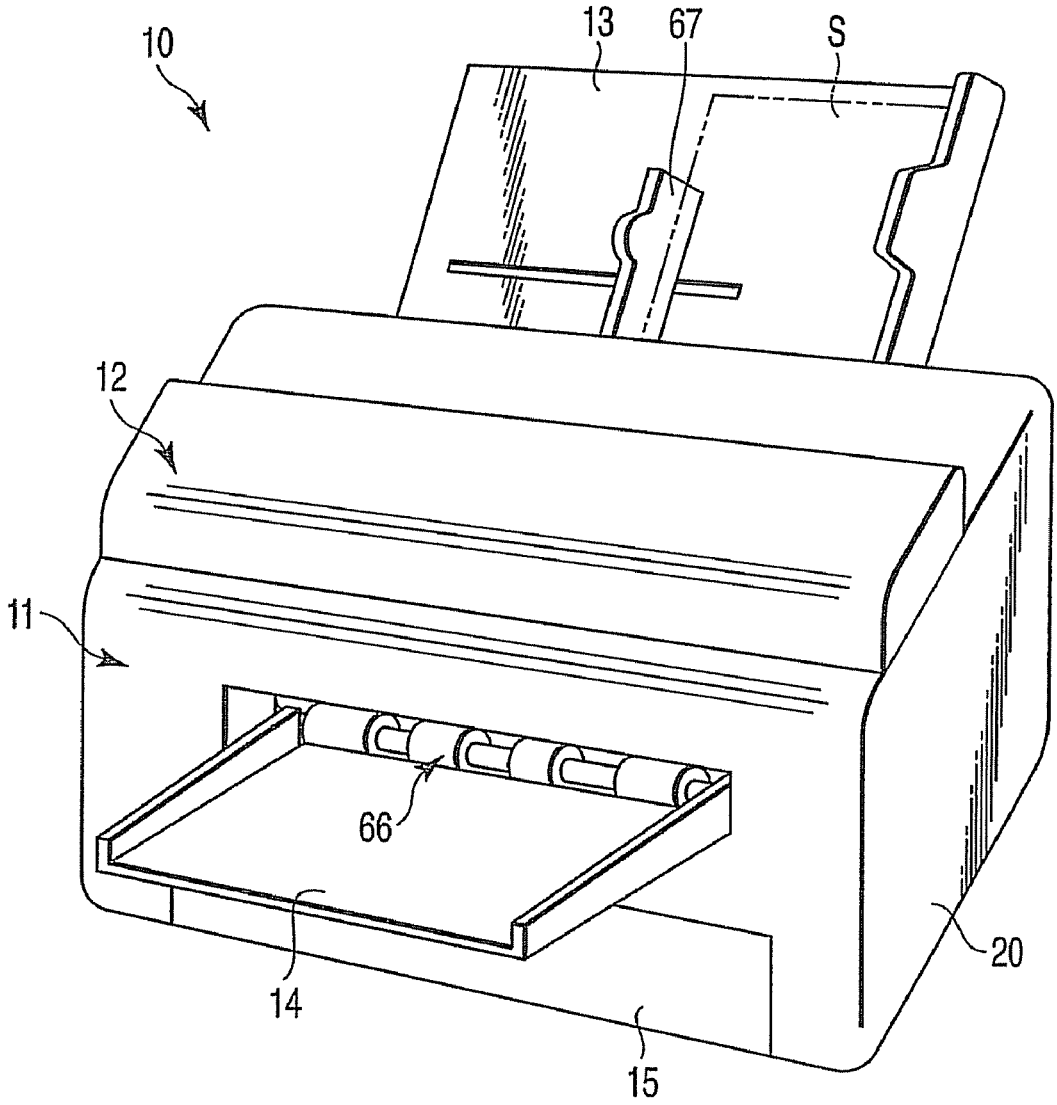
FIG. 1 is a perspective view of an image forming apparatus according to an embodiment of the invention.

Hereinafter, an image forming apparatus according to an embodiment of the invention will be described with reference to FIG. 1 to FIG. 5. FIG. 1 shows the outer appearance of an image forming apparatus 10. The image forming apparatus 10 has a function to print an image on a sheet such as, for example, a printing paper. As shown in FIG. 1, the image forming apparatus 10 includes a main body unit 11, a head receiving unit 12 arranged at an upper part of the main body unit 11, a first supply tray 13 arranged at a rear part of the main body unit 11, an ejection tray 14 arranged at a front part of the main body unit 11, a second supply tray 15 received in a lower part of the main body unit 11, a temporal holding tray 16 arranged at a back surface of the main body unit 11, and the like.

Figure 2:
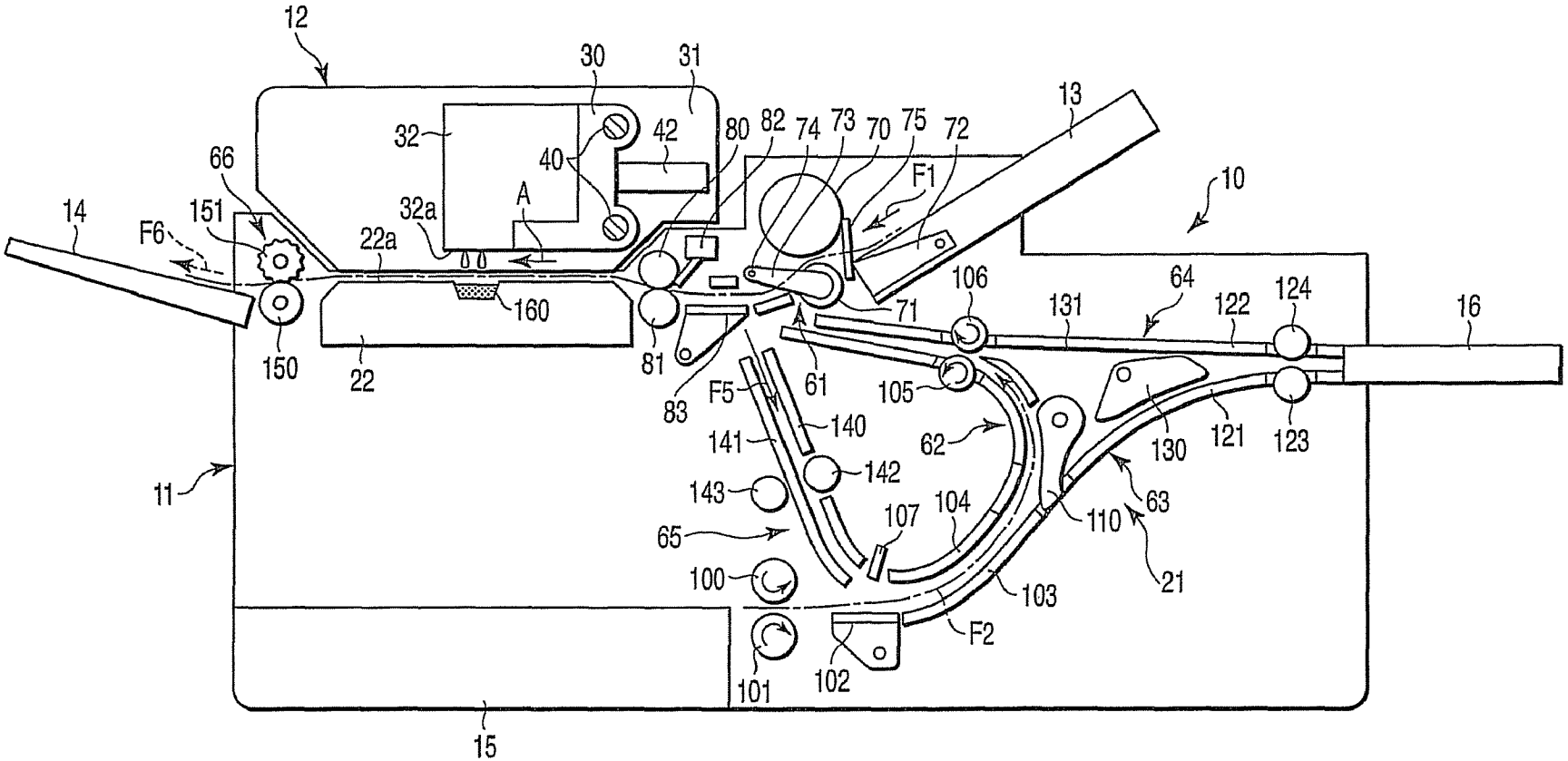
FIG. 2 is a side view schematically showing the inside of the image forming apparatus.

FIG. 2 schematically shows the inside of the image forming apparatus 10. The main body unit 11 includes a housing 20, a sheet transport mechanism 21 constructed inside the housing 20, a sheet guide member 22 having a guide unit 22*a* in the horizontal direction, a head cleaning mechanism 24 shown in FIG. 3, and the like. The sheet guide member 22 and the head cleaning mechanism 24 will be described later in detail.

A carriage 30, a carriage drive mechanism 31 to drive the carriage 30, a recording head 32 of an ink-jet system mounted on the carriage 30 and the like are arranged in the head receiving unit 12. An exchangeable ink cartridge (not shown) is received in the recording head 32. As shown in FIG. 2, the recording head 32 includes a nozzle unit 32*a* opening downward to the guide unit 22*a* of the sheet guide member 22, and an ink discharge mechanism (not shown) to discharge ink from the nozzle unit 32*a*. The recording head 32 forms an image on a sheet S (shown in FIG. 3) by this ink. An arrow A in FIG. 3 indicates a transport direction of the sheet S.

An example of the ink discharge mechanism is a thermal type. In the thermal type, heat is applied to ink by a heater incorporated in the recording head 32, so that the ink is film-boiled. A change in pressure occurs in the ink by the growth or contraction of a bubble by this film-boiling. The ink is discharged from the nozzle unit 32*a* by this change in pressure, so that an image is formed on the sheet S. In addition to the thermal type, the ink discharge mechanism using an element (for example, piezoelectric element) having a piezoelectric effect may be adopted. For example, the piezoelectric element is deformed by an electric current, and ink is discharged from the nozzle unit by the pumping action based on the deformation.

Figure 3:
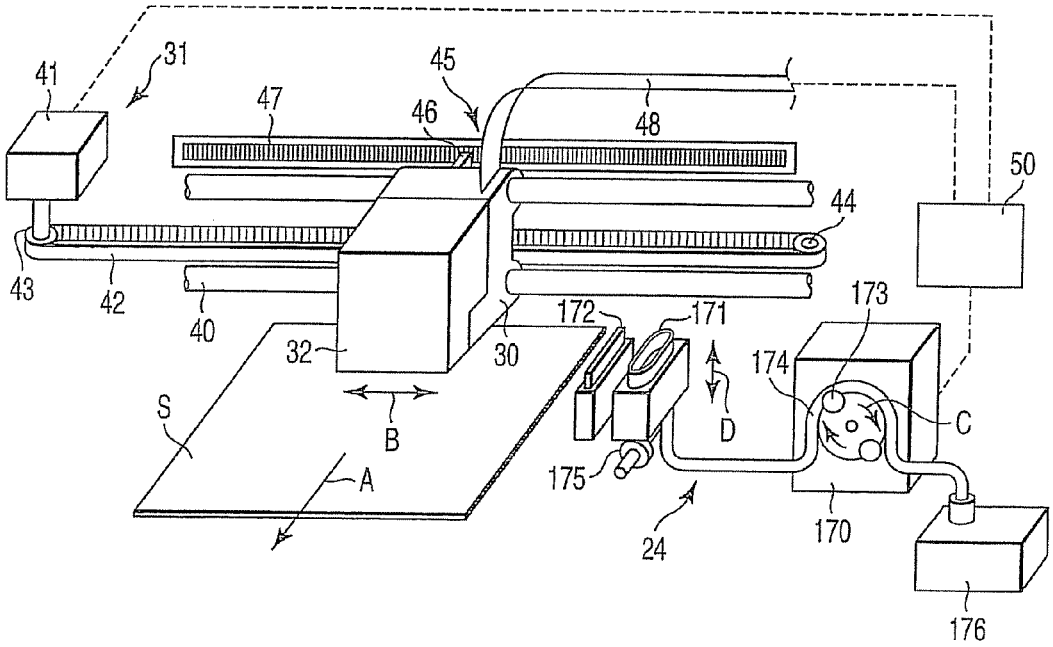
FIG. 3 is a perspective view of a carriage drive mechanism and a head cleaning mechanism of the image forming apparatus.

As shown in FIG. 3, the carriage drive mechanism 31 includes a carriage guide 40 extending in the horizontal direction, a motor 41 such as a stepping motor, power transmission members such as a timing belt 42 and sprockets 43 and 44, a sensor unit 45 for controlling the position of the carriage 30 and the like. The carriage guide 40 extends in a direction B orthogonal to the transport direction of the sheet S. The carriage guide 40 is supported by a frame of the head receiving unit 12. The recording head 32, together with the carriage 30, can be reciprocated in the direction (arrow B direction) orthogonal to the transport direction of the sheet S along the carriage guide 40.

The rotation of the motor 41 is transmitted to the carriage 30 through the timing belt 42. Thus, the recording head 32 reciprocates along the carriage guide 40. The sensor unit 45 for controlling the position of the carriage 30 includes, for example, an encoder sensor 46 and a ladder plate 47 as a unit to be detected. The ladder plate 47 extends in the direction parallel to the carriage guide 40. The ladder plate 47 has a ladder pattern formed at an equal pitch. The ladder pattern of the ladder plate 47 is optically detected by the encoder sensor 46 according to the position of the carriage 30, so that the position of the carriage 30 is detected. A signal of the detected position is inputted to a control unit 50 through a flexible harness 48.

As shown in FIG. 2, the sheet transport mechanism 21 includes an upper transport unit 61 to feed a sheet from the first supply tray 13, a first transport unit (first transport path) 62 to feed a sheet (normal sheet) from the second supply tray 15, a second transport unit (second transport path) 63 and a third transport unit (third transport path) 64 which feed a sheet (thick sheet), a two-sided printing transport unit 65 used when two-sided printing is performed, and an ejection mechanism 66. The first transport unit 62 transports the sheet taken out from the first supply tray 13 to the recording head 32. The second transport unit 63 transports the sheet taken out from the first supply tray 15 to the temporal holding tray 16. The third transport unit 64 transports the sheet taken out from the temporal holding tray 16 to the recording head 32. The ejection mechanism 66 has a function to eject the printed sheet onto the ejection tray 14.

Plural sheets (for example, printing papers) are stacked in the thickness direction and can be placed on the first supply tray 13. As shown in FIG. 1, a movable guide 67 is provided on the first supply tray 13. The movable guide 67 can be moved in the width direction of the sheet S according to the size of the sheet S. The movable guide 67 is moved in the width direction of the sheet S, so that the position of the sheet S in the width direction on the first supply tray 13 can be regulated.

The upper transport unit 61 includes a supply roller 70, a separation roller 71 positioned below the supply roller 70, a separation unit 72 including a separation pad and the like. The supply roller 70 supplies the sheet taken out from the lower end of the first supply tray 13 to the recording head 32. A torque limiter is provided on the separation roller 71.

The separation roller 71 rotates in the same direction as the supply roller 70 by the function of the torque limiter in the case where only one sheet exists between the supply roller 70 and itself. In the case where two or more sheets exist between the supply roller 70 and the separation roller 71, the separation roller 71 rotates in the reverse direction to the supply roller 70. Accordingly, in the case where plural sheets are taken out from the first supply tray 13 and are sent to between the supply roller 70 and the separation roller 71, the sheet at the uppermost part and the other sheets are separated from each other, and only the sheet at the uppermost part is supplied to the recording head 32. The supply roller 70, the separation roller 71, the separation unit 72 and the like constitute a sheet separation mechanism to take out the sheet one by one from the first supply tray 13.

The separation roller 71 is held by a holder 73. The holder 73 can move in the vertical direction around a shaft 74 extending in the horizontal direction. The separation roller 71 is brought into contact with the supply roller 70 at a specified load by a spring and is separated from the supply roller 70 by a not-shown cam. The separation unit 72 can be moved by the not-shown cam in the direction of approaching or separating from the supply roller 70.

The separation roller 71 and the separation unit 72 are respectively separated from the supply roller 70 after the sheet is supplied, are moved to a standby position, and are on standby until the time of next sheet supply. A return lever 75 is rotatably arranged in the vicinity of the lower end of the first supply tray 13. The return lever 75 is retracted by a spring to a position where the transport of the sheet is not prevented when the sheet taken out from the first supply tray 13 is transported to the supply roller 70. The return lever 75 is rotated in synchronization with the movement of the separation roller 71 and the separation unit 72 to the standby position, and returns the remaining sheet to the first supply tray 13.

The upper transport unit 61 includes a transport roller 80, a pinch roller 81 opposite to the transport roller 80, a sheet sensor 82, a switching member 83 and the like. The transport roller 80 supplies the sheet to between the sheet guide member 22 and the recording head 32. The sheet sensor 82 includes a sensor arm capable of detecting the positions of the front end and the rear end of the sheet.

Figure 4:
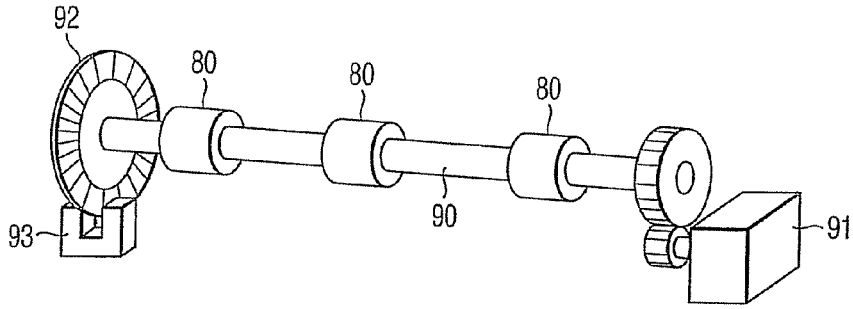
FIG. 4 is a perspective view of a part of a sheet transport mechanism of the image forming apparatus.

As shown in FIG. 4, the transport roller 80 is attached to a shaft 90. The shaft 90 is rotated by a controllable motor 91 such as a stepping motor. The pinch roller 81 opposite to the transport roller 80 is in contact with the transport roller 80 by a not-shown spring. A disk-like ladder wheel 92 is attached to the shaft 90 of the transport roller 80. A ladder pattern is formed in the circumferential direction at a constant pitch on the ladder wheel 92. The ladder wheel 92 is detected by the sensor 93, and the input is made to the control unit 50. By this, the rotation of the transport roller 80 is controlled, and the transport of the sheet is controlled at the time of image formation.

The sheet taken out from the first supply tray 13 by the supply roller 70 passes through the upper transport unit 61 as indicated by an arrow F1 in FIG. 2 and is transported to between the transport roller 80 and the pinch roller 81. The leading end of the sheet is detected by the sheet sensor 82, and positioning for the image formation is performed. This sheet passes between the upper surface (guide unit 22*a*) of the sheet guide member 22 and the recording head 32 by the rotation of the transport roller 80. At that time, the image formation is performed on the sheet S by the recording head 32. Ribs functioning as the transport reference surface are formed on the guide unit 22*a* of the sheet guide member 22. These ribs hold the height of the sheet suitably and prevent the sheet from corrugating. The sheet on which an image has been formed is transported to the ejection mechanism 66.

The first transport unit 62 includes rollers 100 and 101 to take out the sheet from the cassette type second supply tray 15, a switching member 102, guide members 103 and 104 to guide the taken-out sheet, a transport roller 105 provided at the midpoint of the guide members 103 and 104, and a pinch roller 106 opposite to the transport roller 105. The pinch roller 106 is pressed to the transport roller 105 by a spring. Plural sheets (for example, printing papers) are stacked in the thickness direction and can be contained in the second supply tray 15. The rollers 100 and 101 of the second transport unit 62 function as a sheet separation mechanism to take out the sheet one by one from the second supply tray 15.

A media sensor 107 is arranged to be opposite to the switching member 102. The media sensor 107 has a function to detect the quality (for example, paper quality) of the sheet. For example, in the case where the surface of the sheet is made of a hygroscopic substance, a signal to increase the amount of ink to be discharged from the recording head 32 is outputted to the control unit 50. In the case where the surface of the sheet is a glossy sheet, for example, a coat paper, control is performed so that a signal to decrease the amount of ink to be discharged from the recording head 32 is outputted to the control unit 50. In the case of color printing, based on a signal from the media sensor 107, a discharge ratio of plural color components may be adjusted.

A first switching mechanism 110 to the second transport unit 63 is provided at the midpoint of the guide members 103 and 104. The first switching mechanism 110 is normally at the position shown in FIG. 2 where the sheet is transported by the first transport unit 62, and has a function to switch the transport of the sheet to the second transport unit 63 side at a specified timing. The timing when the sheet is transported to the second transport unit 63 side will be described later.

The sheet taken out from the second supply tray 15 passes through the switching member 102 and passes the guide members 103 and 104 of the second transport unit 62 as indicated by an arrow F2 in FIG. 2. Further, this sheet is transported to the transport roller 80 by the rollers 105 and 106, and is supplied to between the recording head 32 and the sheet guide member 22.

The second transport unit 63 includes guide members 121 and 122 for guiding the sheet to the temporal holding tray 16 side from the midpoint of the first transport unit 62, a transport roller 123 provided at the midpoint of the guide members 121 and 122, and a pinch roller 124 opposite to the transport roller 123. The pinch roller 124 is pressed to the transport roller 123 by a spring. A second switching mechanism 130 to switch between the second transport unit 63 and the third transport unit 64 is provided at the midpoint of the guide members 121 and 122. The second switching mechanism 130 is normally at the position shown in FIG. 2, keeps the transport path of the sheet from the second transport unit 63 to the temporal holding tray 16, and has a function to switch the transport of the sheet from the temporal holding tray 16 to the third transport unit 64 at a specified timing. The timing when the sheet is transported to the third transport unit 64 side will be described later.

The third transport unit 64 includes a guide member 131 to guide the sheet from the temporal holding tray 16 to the recording head 32 side.

Here, a transport method of the sheet from the second supply tray 15 will be described. After the sheet is taken out one by one from the second supply tray 15 by the rollers 100 and 101 of the second transport unit 62, the thickness of the sheet and the quality of material are detected by the media sensor 107. By this, it is detected whether the sheet is a normal sheet which can pass through the second transport unit 62 having a small curvature, or a thick sheet unsuitable for the passing. Since the thick sheet is tough, when it is made to pass through the transport path with a small curvature, there is a fear that a curl occurs or a paper jam occurs, and therefore, the transport is performed using the second transport unit 63 and the third transport unit 64 with a large curvature.

When the sheet is detected to be the normal sheet by the media sensor 107, the first switching mechanism 110 and the second switching mechanism 130 are put at the positions of FIG. 2, and as indicated by the arrow F2 in FIG. 2, the transport is performed by the second transport unit 62 in the direction toward the recording head 32.

Figure 5:
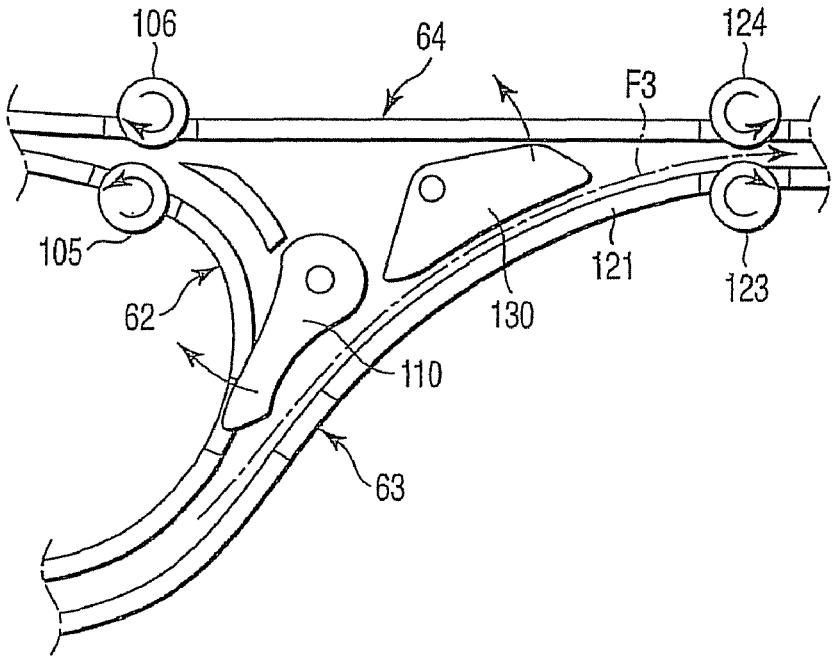
FIG. 5 is a side view schematically showing an operation example of a guide operation in the image forming apparatus.
Figure 6:
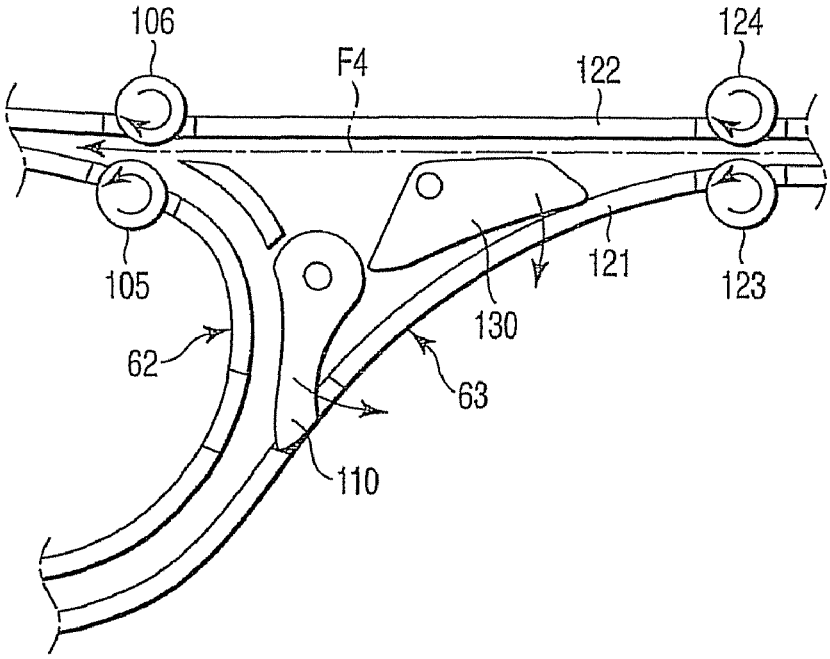
FIG. 6 is a side view schematically showing an operation example of the guide operation in the image forming apparatus.

On the other hand, when the sheet is detected to be the thick sheet by the media sensor 107, the first switching mechanism 110 and the second switching mechanism 130 swing as shown in FIG. 5, and as indicated by a two-dot chain line F3 in FIG. 5, the sheet is transported to the temporal holding tray 16 by the second transport unit 63 and is temporarily held. Subsequently, the first switching mechanism 110 and the second switching mechanism 130 swing as shown in FIG. 6, and as indicated by a two-dot chain line F4 in FIG. 6, the transport is performed from the temporal holding tray 16 in the direction toward the recording head 32.

Finally, the sheet from the second supply tray 15 is transported to between the transport roller 80 and the pinch roller 81, and similarly to the sheet from the first supply tray 13, the image formation is performed on the sheet S by the recording head 32, and the sheet is transported to the ejection mechanism 66.

The two-sided printing transport unit 65 includes guide members 140 and 141, a transport roller 142 provided at the midpoint of the guide members 140 and 141, and a pinch roller 143 opposite to the transport roller 142. The pinch roller 143 is pressed to the transport roller 142 by a spring. The guide members 140 and 141 are arranged between the switching member 83 of the upper transport unit 61 and the switching member 102 of the first transport unit 62. At the time of two-sided printing, the sheet is made to pass in an arrow F5 direction in FIG. 2. The transport rollers 80, 105 and 142 are such that a rubber resin such as EPDM (ethylene propylene diene rubber) is provided on a metal shaft, and has a function to transport the sheet S by friction.

In the case where the two-sided printing is performed, after one side of a sheet is printed by the recording head 32, the rear end of this sheet is detected by the sheet sensor 82. Immediately after that, the transport roller 80 is reversely rotated, and the position of the switching member 83 is switched. By this, the sheet is sent to the two-sided printing transport unit 65 as indicated by the arrow F5 in FIG. 2. Further, this sheet is transported by the rollers 142 and 143, passes through the switching member 102, and passes the guide members 105 and 106 of the first transport unit 62. In this way, the sheet turns over, and this sheet is again sent to the recording head 32 by the transport roller 80, so that the other side of the sheet is printed.

The ejection mechanism 66 includes an ejection roller 150, a star wheel 151, a transmission mechanism (not shown) to transmit the rotation of the transport roller 80 to the ejection roller 150 and the star wheel 151, and the like. The star wheel 151 is a gear-like wheel made of a thin plate of stainless steel or the like. The sheet printed by the recording head 32 is pressed to the ejection roller 150 by the star wheel 151, and is transported in a direction indicated by an arrow F6 toward the ejection tray 14. The star wheel 151 prevents the sheet after printing from rising from the ejection roller 150.

As shown in FIG. 2, an ink absorption unit 160 is formed on the upper side of the sheet guide member 22. The ink absorption unit 160 is opposite to the nozzle unit 32*a* of the recording head 32, and is formed at a position lower than the guide unit 22*a*. The width of the ink absorption unit 160 is larger than the width of the sheet S. In the case where frameless printing of a sheet is performed, surplus ink protruding from the edge of the sheet is absorbed by this ink absorption unit 160, so that it is prevented that a subsequent sheet is soiled.

The head cleaning mechanism 24 shown in FIG. 3 includes a suction pump 170 for cleaning the recording head 32, a cap 171 for preventing drying of the recording head 32, a blade member 172 for cleaning the nozzle unit 32*a* of the recording head 32, and the like. In an example of the suction pump 170, a tube 174 is squeezed in a direction indicated by an arrow C by a rotator 173, so that a negative pressure is generated inside the cap 171.

The cap 171 can be moved in the vertical direction (an arrow D direction in FIG. 3) by a drive mechanism 175. In the drive mechanism 175, for example, a motor-driven actuator 176 such as a solenoid is used as a drive source, and the cap 171 is moved up and down. Incidentally, the rotation of the motor is converted into a linear movement by a cam or a link mechanism, and the cap 171 may be moved up and down. When the recording head 32 is maintained, the cap 171 is raised to the recording head 32, and the cap 171 is brought into close contact with the recording head 32. In this state, the suction pump 170 is actuated, so that the surplus ink attached to the nozzle unit 32*a* of the recording head 32 is sucked. The sucked waste ink is ejected into a waste ink tank 176. Thereafter, the cap 171 is separated from the recording head 32, and the nozzle unit 32*a* of the recording head 32 is cleaned by the blade member 172.

According to the foregoing embodiments, in the case where the paper cassette is arranged below the head recording unit in order to increase the paper capacity, even if a thick sheet is used, it is possible to prevent a curl or a paper jam from occurring.

Incidentally, the invention can also be applied to an image forming apparatus for printing on a sheet other than a printing paper, for example, paper of various forms, or a sheet made of cloth, plastic or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming apparatus for printing on a sheet by a recording head of an ink-jet system, comprising:

means for transporting the sheet in a specified direction;

means arranged below the recording head and for containing the stacked sheet before printing in a paper loading unit;

means for transporting the sheet through a first transport path from the paper loading unit to between the recording head and the sheet guide member while inverting the sheet;

means for transporting the sheet through a second transport path from the paper loading unit to a temporal containing unit in a state where a front-back surface of the sheet is kept; and means for transporting the sheet through a third transport path from the temporal containing unit to between the recording head and a sheet guide member in a state where the front-back surface of the sheet is kept.

2. The image forming apparatus according to claim 1, further comprising means for transporting the sheet through a first transport path from the paper loading unit to between the recording head and the sheet guide member while inverting the sheet; and switching means for switching a transport direction of the sheet supplied from the paper loading unit between the first transport path and the second transport path.

3. The image forming apparatus according to claim 2, wherein the switching means is operated based on a kind of the sheet contained in the paper loading unit.

4. The image forming apparatus according to claim 3, wherein the switching means switches to the first transport path when a thickness of the sheet is less than a specified thickness and to the second transport path when the thickness of the sheet is the specified thickness or more.

5. The image forming apparatus according to claim 3, wherein the kind of the sheet is determined by a media sensor provided in an ejection port of the paper loading unit.

6. The image forming apparatus according to claim 1, wherein a length of a side, along a transport direction, of a maximum size of the sheet transported to the second transport path is not longer than a length of a short side of the maximum size of the sheet printed by the recording head.

7. The image forming apparatus according to claim 1, further comprising:

means for moving the recording head in a direction orthogonal to the transport direction of the sheet; and means for forming an image on the sheet by discharging ink from the recording head to the sheet.

8. The image forming apparatus according to claim 1, wherein a front end of the sheet is transported into the temporal containing unit by the means for transporting the sheet through the second transport path, the front end of the sheet corresponding to a back end of the sheet transported out of the temporal containing unit by the means for transporting the sheet through the third transport path.

9. An image forming apparatus for printing on a sheet by a recording head of an ink-jet system, comprising:

a sheet transport mechanism which transports the sheet in a specified direction;

a containing unit that is arranged below the recording head and contains the stacked sheet before printing in a paper loading unit;

a first transport unit that transports the sheet through a first transport path from the paper loading unit to between the recording head and the sheet guide member while inverting the sheet;

a second transport unit that transports the sheet through a second transport path from the paper loading unit to a temporal containing unit in a state where a front-back surface of the sheet is kept; and a third transport unit that transports the sheet through a third transport path from the temporal containing unit to between the recording head and the sheet guide member in a state where the front-back surface of the sheet is kept.

10. The image forming apparatus according to claim 9, further comprising:

a moving unit that moves the recording head in a direction orthogonal to the transport direction of the sheet; and an image forming unit that forms an image on the sheet by discharging ink from the recording head to the sheet.

* * * * *